United States Patent [19]

McMahon

[11] 4,304,571

[45] Dec. 8, 1981

[54] COAL BENEFICIATION

[75] Inventor: Matthew A. McMahon, Wappingers Falls, N.Y.

[73] Assignee: Texaco Inc., White Plains, N.Y.

[21] Appl. No.: 182,898

[22] Filed: Sep. 2, 1980

[51] Int. Cl.[3] ..... C10L 9/02; C10L 9/08

[52] U.S. Cl. ..... 44/15 R; 44/1 G

[58] Field of Search ..... 44/1 R, 1 B, 1 C, 1 G, 44/1 SR; 208/9; 201/17

[56] References Cited

U.S. PATENT DOCUMENTS

| | | | |
|---|---|---|---|
| 1,981,614 | 11/1934 | Francis | 208/9 |
| 3,988,238 | 10/1976 | McCollum et al. | 208/9 |
| 4,018,571 | 4/1977 | Cole et al. | 44/1 R |
| 4,121,910 | 10/1978 | Stambaugh | 44/1 B |

*Primary Examiner*—Carl F. Dees

*Attorney, Agent, or Firm*—Carl G. Ries; Robert A. Kulason; Robert Knox, Jr.

[57] ABSTRACT

The BTU value of a solid fuel is increased by subjecting the fuel to hydrothermal treatment in the presence of an added decarboxylation catalyst.

9 Claims, No Drawings

COAL BENEFICIATION

This invention relates to the upgrading of solid fuels. More particularly, it is concerned with the beneficiation of low rank solid fuels such as sub-bituminous coal and lignite.

Millions of tons of low rank solid fuels exist in this country and, although many of these deposits may be readily mined, they are not used extensively as fuels because for the most part, they are located at a great distance from the point of ultimate use and in addition they have several characteristics which make them less valuable as fuels. For example, these low rank solid fuels, although generally they have a relatively low sulfur content, still contain too much sulfur to permit their use as a fuel and yet meet the current regulations with respect to $SO_2$ emissions. In addition, to make these coals economically attractive, means must be found for separating the components of the coal having little or no heating value from those components having a high heating value. Thus, inorganic mineral matter, water and carbon dioxide are desirably removed from such fuels to produce a fuel having a higher BTU per pound value and thereby produce a fuel which is more economic to transport either by rail or pipeline.

The removal of ash-forming minerals from coal is difficult and ordinary beneficiation techniques such as jigging, tabling and sink and float techniques are not particularly efficient with the lower rank coals. Ash-forming minerals generally occur in mined coals either as "segregated impurities" or as an inherent part of the coal. The segregated ash forming impurities are those that exist as individual discrete particles when the coal has been broken down. They are composed, for the most part, of shale, clay, sand, stone and other mineral material derived either from strada interbedded with the coal or from the roof and floor of the coal bed. Ordinarily, they are removable by mechanical means. On the other hand, the term "inherent" or "fixed" ash is used to distinguish that part of the impurity in the coal which cannot be separated by mechanical means. For economic and practical reasons, therefore, it is desirable to reduce the ash content of the fuel but conventional procedures have little effect on the fixed ash.

Another undesirable characteristic, particularly in the case of low quality fuels such as sub-bituminous coal and lignite, is that these fuels contain a considerable amount of combined or bound water. This is a most undesirable ingredient in that although bound water is present in the solid fuel it does not play any part in the formation of the slurry vehicle and consequently it has little effect on the viscosity of pumpability of a solid fuel-water slurry. This means that if the fuel is to be transported by pipeline additional energy is consumed in the movement of the slurry. Additionally, the bound water affects the use of the fuel as its presence in the combustion zone results in a reduced flame temperature. It is therefore desirable to remove as much combined or bound moisture as conveniently practical from the solid fuel prior to its transportation or use.

It is also desirable to reduce the oxygen content of the solid fuel and as a result, increase its BTU value.

It is, therefore, an object of this invention to reduce the sulfur content of solid fuels. Another object is to reduce the bound water content of solid fuels. Still another object is to increase the heating value of solid fuels by reducing the ash and oxygen content thereof.

These and other objects will be obvious to those skilled in the art from the following disclosure.

These objects can be fulfilled by subjecting the solid fuel to hydrothermal treatment in the presence of a decarboxylation catalyst.

According to the invention, there is provided a process for the beneficiation of a solid fuel which comprises forming a mixture of particulate solid fuel and water, heating the mixture to a temperature between about 300° F. and 706° F. at a pressure sufficient to maintain substantially all of the water in liquid state in the presence of an added catalytic amount of a decarboxylation catalyst.

The feed used in the process of our invention includes any solid carbonaceous combustible material containing ash-forming ingredients and/or sulfur compounds and/or bound water and carboxylates and mixtures thereof. Such materials include bituminous coal, sub-bituminous coal, lignite, biomass, organic waste and the like. The feed solid fuel should be ground so that at least 80% and preferably 100% passes through a U.S. Standard 14 mesh sieve, the finer the grind, the faster and more complete the reaction for a given set of reaction conditions.

The particulate solid fuel and water are mixed in an amount to provide a mixture containing from about 30 to 65 weight % solids with 40 to 60% solids being preferred. If the process is of the batch type, the solid fuel and water may be charged separately to the reaction zone such as an autoclave or they may be charged together as a slurry. In such latter event, the water excluding bound water should be present in the slurry in an amount between about 40 and 60 weight % as, if the water content is less than about 40 percent, the slurry may be difficult to pump. Such a slurry is also used when the process is of the continuous type where the slurry is, for example, passed through an elongated tubular hydrothermal.

The hydrothermal or beneficiation treatment is well known and is disclosed, for example, U.S. Pat. Nos. 4,018,571 and 4,104,035 to Cole et al, the disclosures of which are incorporated herein by reference. As practiced in the process of the invention, it may be effected under either static or dynamic conditions. In one embodiment of the invention, the slurry is introduced into a pressure vessel which is then sealed and heated under autogenous pressure to a temperature between about 300° and 706° F., preferably between 400° and 650° F., with the pressure being such that water in the liquid state is maintained in the reaction vessel. After a period of time between about one minute and two hours, the vessel is vented and the slurry removed therefrom.

In another embodiment of the invention, the solid fuel-water slurry is passed under conditions of turbulent flow through an elongated tubular reaction zone. The continuous reaction conditions are substantially the same as those recited above for the batch type of operation.

To assist in the removal of oxygen, the hydrothermal treatment is carried out in the presence of a decarboxylation catalyst comprising a soluble salt of copper, nickel or vanadium such as the chloride, benzoate, carbonate, acetate and the like, i.e. any salt that is soluble to at least 0.1 wt. % in the reaction mixture.

The catalyst may be present in the slurry in an amount between about 1 and 15 percent based on the total weight of the slurry with concentrations of from 4 to 8 weight percent being preferred.

When the catalyst is reduced to a lower valence state, it may be regenerated by contact with a free oxygen containing gas such as air, oxygen enriched air or substantially pure oxygen. In the batch type of process, the oxygen-containing gas may be pressured into the pressure vessel or introduced into the reaction zone before the run is started and the reaction vessel sealed. Similarly, in the continuous process the oxygen-containing gas may be introduced with the slurry feed or at one or various stages of the reaction.

The reaction may be promoted by the presence of salts of magnesium, cobalt and barium present in an amount between about 0.001 and 0.2 moles per 100 g of solid fuel.

The following examples are submitted for illustrative purposes only and it should not be construed that the invention is restricted thereto.

EXAMPLE I

The feed in this example is a sub-bituminous coal having the following analysis:

TABLE 1

| Ultimate Analysis | As Received | Moisture and Ash Free |
|---|---|---|
| Moisture % | 23.9 | — |
| Carbon % | 45.5 | 71.21 |
| Hydrogen % | 5.9 | 5.05 |
| Nitrogen % | 0.69 | 1.08 |
| Sulfur % | 0.71 | 1.11 |
| Ash % | 12.2 | — |
| Oxygen % (By difference) | 11.1 | 21.57 |
| Calorific Value, BTU/lb. | 7637 | 12088 |

The coal was air dried at room temperature and pulverized in a hammer mill to minus 60 mesh. Several 200 gram portions of coal were then riffled from the large batch of coal to use for a series of hydrothermal treatment experiments.

To a two liter steel bomb equipped for operation at high pressure were added 200 grams of coal, 400 grams of water and an amount of cupric acetate listed below in Table 2. The bomb was then sealed, flushed with nitrogen and pressured except in Run 1 to 200 psig with nitrogen. The bomb was then heated with rocking to the desired temperature. After 30 minutes at this temperature the apparatus is cooled to 300° F. and the water and gas is vented. After cooling to room temperature, the coal is removed from the bomb and washed with 200 ml. of water on a Buchner funnel to remove the residual catalyst from the coal. The product coal is air dried, ground to minus 60 mesh and sampled for analysis. The results of these runs are summarized in Table 2.

TABLE 2

| Run No. | Temp. °F. | Max Pressure PSIG | Cupric Acetate g | %$O_2$ (MAF)* in coal | BTU/lb. (MAF)* |
|---|---|---|---|---|---|
| ** | — | — | — | 21.57 | 12088 |
| 1 | 500 | 700 | 4 | 21.24 | 12019 |
| 2 | 500 | 1150 | 8 | 19.18 | 12440 |
| 3 | 500 | 1200 | 0 | 22.30 | 12159 |
| 4 | 400 | 620 | 8 | 20.30 | 12343 |
| 5 | 400 | 630 | 0 | 21.93 | 11813 |

*Moisture and ash free
**Untreated

It is clear from the results presented in Table 2 that the addition of cupric acetate benefically decreases the oxygen content of the coal. When the higher concentration of catalyst is used, the loss of oxygen from the coal is reflected in an increase in the BTU content relative to control runs and feed coal. At low catalyst concentrations, the change in BTU appears to be small and within experimental error.

EXAMPLE II

The runs in this example are substantial duplicates of the runs in Example I, the differences being that the bomb was initially flushed with oxygen, pressured with oxygen to the pressure designated in Table 3 at room temperature and then pressured to a 200 psig total pressure with nitrogen. Data on these runs appear below in Table 3.

TABLE 3

| Run No. | Temp. °F. | Max. Pressure PSIG | Cupric Acetate g | Charged $O_2$ psi | Charged $O_2$ moles | % $O_2$ in Treated coal (MAF)* | BTU/lb. (MAF)* |
|---|---|---|---|---|---|---|---|
| 7 | 500 | 1125 | 8 | 15 | 0.044 | 20.2 | 12804 |
| 8 | 500 | 1200 | 8 | 45 | 0.122 | 17.2 | 13143 |
| 9 | 500 | 1200 | 8 | 65 | 0.172 | 19.7 | 12381 |

*Moisture and ash free

The results in Table 3 clearly demonstrate the beneficial effect of oxygen when used in conjunction with cupric acetate in the hydrothermal treatment of a low quality coal over the runs in Table 2 which were carried out in an inert atmosphere in the absence of added hydrogen. In Runs 7, 8 and 9 the average sulfur reduction was about 10%. Similar results are obtainable with the soluble salts of nickel and vanadium.

From the foregoing, it can be seen that the use of a decarboxylation catalyst permits the hydrothermal treatment to be run at lower temperatures and pressures than conventional hydrothermal treatments. Since the catalysts are water-soluble, they can be recovered and re-used. Additional benefits by way of lower temperatures and pressures for equivalent decarboxylation are obtained when the water used in the hydrothermal treatment contains from 1 to 5 wt. % alkali metal compound such as sodium carbonate or sodium hydroxide.

Various modifications of the invention as hereinbefore set forth may be made without departing from the spirit and scope thereof and therefore only such limitations should be made as are indicated in the appended claims.

I claim:

1. A process for the beneficiation of a low rank solid fuel which comprises forming a mixture of particulate low rank solid fuel and water, heating the mixture to a temperature between about 300° F. and 706° F. at a pressure sufficient to maintain substantially all of the water in the liquid state in the presence of an added catalytic amount of a decarboxylation catalyst comprising a soluble salt of a metal selected from the group consisting of vanadium, copper and nickel.

2. The process of claim 1 in which the solid fuel comprises sub-bituminous coal.

3. The process of claim 1 in which the solid fuel comprises lignite.

4. The process of claim 1 in which the salt is a cupric salt.

5. The process of claim 1 in which the salt is the acetate.

6. The process of claim 4 in which the salt is the acetate.

7. The process of claim 1 in which the beneficiation treatment is carried out in the presence of a free-oxygen containing gas.

8. The process of claim 7 in which the metal salt comprises cupric acetate.

9. The process of claim 1 in which the hydrothermal treatment is carried out in the presence of added alkali or alkaline earth metal compound.

* * * * *